US008283288B2

(12) United States Patent
Shinohara et al.

(10) Patent No.: US 8,283,288 B2
(45) Date of Patent: Oct. 9, 2012

(54) THERMAL TRANSFER RECEIVING SHEET

(75) Inventors: Hideaki Shinohara, Tokyo (JP); Yoshihiro Shimizu, Tokyo (JP); Yoshio Mizuhara, Tokyo (JP); Mitsuru Tsunoda, Tokyo (JP)

(73) Assignee: Oji Paper Co., Ltd., Tokyo (JP)

( * ) Notice: Subject to any disclaimer, the term of this patent is extended or adjusted under 35 U.S.C. 154(b) by 905 days.

(21) Appl. No.: 11/795,146

(22) PCT Filed: Jan. 20, 2006

(86) PCT No.: PCT/JP2006/301255

§ 371 (c)(1),
(2), (4) Date: Jul. 12, 2007

(87) PCT Pub. No.: WO2006/080410

PCT Pub. Date: Aug. 3, 2006

(65) Prior Publication Data

US 2008/0008896 A1 Jan. 10, 2008

(30) Foreign Application Priority Data

Jan. 28, 2005 (JP) ..... 2005-021368

(51) Int. Cl.
*B41M 5/035* (2006.01)
*B41M 5/50* (2006.01)

(52) U.S. Cl. ..... 503/227; 8/471

(58) Field of Classification Search ..... None
See application file for complete search history.

(56) References Cited

U.S. PATENT DOCUMENTS

| | | | | |
|---|---|---|---|---|
| 5,011,814 | A * | 4/1991 | Harrison | 503/227 |
| 5,837,649 | A | 11/1998 | Nozaki | 503/227 |
| 2004/0067345 | A1 | 4/2004 | Hladik et al. | 428/195.1 |
| 2004/0247804 | A1 | 12/2004 | Kim et al. | 428/32.36 |

FOREIGN PATENT DOCUMENTS

| | | |
|---|---|---|
| EP | 1 095 784 | 5/2001 |
| EP | 1 241 017 | 9/2002 |
| EP | 1 457 353 | 9/2004 |
| EP | 1 481 812 | 12/2004 |
| JP | 5-92669 | 4/1993 |
| JP | 6-239036 | 8/1994 |
| JP | 10-29379 | 2/1998 |
| JP | 2002-337463 | 11/2002 |
| JP | 2003-191652 | 7/2003 |
| JP | 2005-313595 | 11/2005 |

OTHER PUBLICATIONS

European Search Report mailed Jan. 30, 2008 (6 pages).

* cited by examiner

*Primary Examiner* — Bruce H Hess
(74) *Attorney, Agent, or Firm* — Kratz, Quintos & Hanson, LLP

(57) ABSTRACT

The present invention provides a thermal transfer receiving sheet comprising a sheet-like support, an image receiving layer containing, as a main component, a dye-dyeable resin formed on one surface of the sheet-like support, and a back surface coating layer containing an adhesive resin formed on the other surface of the sheet-like support, wherein the back surface coating layer contains a polyvinyl pyrrolidone resin in an amount of 1 to 50% by weight based on the total solid content of the back surface coating layer.

5 Claims, No Drawings

THERMAL TRANSFER RECEIVING SHEET

TECHNICAL FIELD

The present invention relates to a thermal transfer receiving sheet (hereinafter referred simply to as a receiving sheet). More particularly, the present invention relates to a receiving sheet which has good printability in an ink jet printer required for a back surface coating layer (hereinafter simply referred to as a back surface layer) of a receiving sheet, and also comprises a back surface layer having sufficient writability for various writing instruments.

BACKGROUND ART

A high image quality color hard copy printing system using a dye thermal transfer system is composed of a printer, a thermal transfer sheet (hereinafter simply referred to as an ink ribbon) and a receiving sheet. As a general method for forming a color image on the receiving sheet, the ink ribbon having color material layers composed of three or four colors i.e. yellow, magenta, cyan and, if necessary, black, is closely contacted with the receiving sheet, which is provided with an image receiving layer (hereinafter, simply referred to as receiving layer), and they are transported through a heating device and pressed by constant pressure from a platen roller. Then, heat generating part of the heating device is selectively made to generate heat, and the dye contained in the color material layers of the ink ribbon is transported to the receiving layer of the receiving sheet to obtain an image. An ink ribbon comprises color material layers consisting of three or four different colored-layers stacked on each other. A color image is formed by sequentially transferring each color, three or four times for each, at the same position of the receiving sheet, thereby superposing each color on the same position. In such a printer of a dye thermal transfer system, the receiving sheet is usually supplied in a sheet state.

Generally, the receiving sheet is formed of a sheet-like support, with a receiving layer formed on one surface thereof, having an excellent dyeing property with dye transferred from an ink ribbon, and a back surface layer formed on the other surface, and provides various properties such as printability in an ink jet printer and writability with various writing instruments.

In the receiving sheet, writing is occasionally performed on the surface (back surface side) opposite the surface of the receiving layer on which an image is formed. It is necessary that writing can be performed by various writing instruments. Recently, printability by an ink jet printer is also required. When the support is a synthetic paper or a plastic film, the support is insufficient in printability in an ink jet printer and is also insufficient in writability for various writing instruments. In order for the back surface layer to have excellent writability, it is necessary that the back surface layer exhibits sufficient writability for oily- or water-based pen-type writing instruments, pencils or the like. Moreover, good printability is also required for printing by a printer, such as an ink jet printer.

As a back surface layer of the thermal transfer receiving paper, some proposals have been made for the purpose of providing writability for various writing materials. In order to improve writability, the back surface layer containing an inorganic pigment includes, for example, a back surface layer containing plate-like barium sulfate (see, for example, Japanese Unexamined Patent Publication (Kokai) No. 9-24676 (page 2)), a back surface layer containing silica microparticles having a specific particle size (see, for example, Japanese Unexamined Patent Publication (Kokai) No. 3-180393 (page 1)), and a back surface layer containing microsilica and acetyl cellulose (see, for example, Japanese Unexamined Patent Publication (Kokai) No. 8-244362 (page 2)).

However, in the back surface layer containing these inorganic pigments, since the inorganic pigments are generally hard, there is a problem that the ink receiving layer may be damaged because the surface of the ink receiving layer is rubbed with the back surface layer when the ink receiving sheet travels through a thermal transfer printer, resulting in poor printing quality. Moreover, printability and drying in an ink jet printer are also insufficient and an improvement is required.

In order to solve the above problem, a back surface layer with low hardness, containing an organic pigment, has also been proposed. For example, there is a back surface layer containing spherical silicone microparticles (see, for example, Japanese Unexamined Patent Publication (Kokai) No. 7-108775 (page 2)), a back surface layer containing cellulose microparticles (see, for example, Japanese Unexamined Patent Publication (Kokai) No. 5-92669 (page 2)), a back surface layer containing organic and/or inorganic particles, a higher aliphatic salt, and a binder as main components (see, for example, Japanese Unexamined Patent Publication (Kokai) No. 1-241491 (Page 1)), and a back surface layer containing particles of a Mohs hardness of 1 to 4 (see, for example, Japanese Unexamined Patent Publication (Kokai) No. 6-239036 (Page 2)). However, in the back surface layer containing an organic pigment, because of slight damage to the receiving layer by the back surface layer, pencil writability is insufficient, and also printability and drying in an ink jet printer are also insufficient.

A proposal to improve writability by mixing inorganic or organic pigment with the back surface layer improves writability by conventional writing instruments such as water- and oil-based pens and pencils to a certain degree. However, in printing with an ink jet printer, sufficient printability and drying cannot be obtained, and performance has been unsatisfactory. In printing with an ink jet printer, because a large amount of water is provided on the back surface layer, it is necessary to design the back surface layer taking into consideration water absorption, drying, and coating film strength, as well as printability.

From these viewpoints, there has been proposed a back surface layer having writability by conventional writing instruments and printability in an ink jet printer (see, for example, Japanese Unexamined Patent Publication (Kokai) No. 2001-199172 (page 2), Japanese Unexamined Patent Publication (Kokai) No. 2001-213057 (Page 2), and Japanese Unexamined Patent Publication (Kokai) No. 2003-191652 (page 2)). However, in these back surface layers, general recording is possible by an ink jet printer, but clear image quality cannot necessarily be obtained. Moreover, because the stability of the back surface layer coating material is insufficient and the cost is high, more improvement is required.

Moreover, as the binder for the back surface, a water-soluble resin, such as polyvinyl pyrrolidone is exemplified (see, for example, Japanese Unexamined Patent Publication (Kokai) No. 2000-185476 (pages 7-8)) or Japanese Unexamined Patent Publication (Kokai) No. 2002-337463 (Page 4). However, when a single-member back surface layer is formed by using a water-soluble resin as a main binder, if printing is performed with an ink jet printer, the drying of the ink is insufficient, and therefore, improvement is required.

DISCLOSURE OF THE INVENTION

The present invention has been made under these circumstance and provides a receiving sheet having a back surface layer with good printability by an ink jet printer and sufficient writability for various writing instruments.

The present invention includes the following respective inventions.

(1) A thermal transfer receiving sheet comprising a sheet-like support, an image receiving layer containing, as a main component, a dye-dyeable resin formed on one surface of the sheet-like support, and a back surface coating layer containing an adhesive resin formed on the other surface of the sheet-like support, wherein the back surface coating layer contains a polyvinyl pyrrolidone resin in an amount of 1 to 50% by weight based on the total solid content of the back surface coating layer.

(2) The thermal transfer receiving sheet according to (1), wherein a weight average molecular weight of the polyvinyl pyrrolidone resin is from 50,000 to 2,000,000.

(3) The thermal transfer receiving sheet according to (1) or (2), wherein the back surface coating layer contains an acrylate ester-based resin as the adhesive resin.

(4) The thermal transfer receiving sheet according to any one of (1) to (3), wherein the back surface coating layer further contains a polyalkylene oxide resin in an amount of 3 to 20% by weight based on the total solid content of the back surface coating layer.

(5) The thermal transfer receiving sheet according to (4), wherein the polyalkylene oxide resin is a polyethylene oxide resin.

(6) The thermal transfer receiving sheet according to any one of (1) to (5), wherein the back surface coating layer contains inorganic fine particles and/or organic fine particles.

In the receiving sheet according to the present invention, the back surface layer of the receiving sheet has good printability in an ink jet printer, good adhesiveness for a stamp, and sufficient writability for various writing instruments.

BEST MODE FOR CARRYING OUT THE INVENTION

The receiving sheet of the present invention is a receiving sheet having a structure in that the receiving layer for receiving a dye is laminated on one surface of a sheet-like support and the back surface layer is laminated on the surface on which the receiving sheet of the sheet-like support is not formed.

(Back Surface Layer)

On the back surface layer of the present invention, a polyvinyl pyrrolidone resin is used in an amount of 1 to 50% by weight based on the total solid content of the back surface layer. The polyvinyl pyrrolidone resin is effective as a material for absorbing water that is the liquid component of the recording media, i.e., ink droplets, or effective as a material for absorbing liquid media for various writing instruments, or further effective as an adhesive resin, or effective for improvement of adhesive strength to the support.

As the adhesive resin used mainly for the back surface layer of the present invention, a conventional adhesive resin can be used and it is also possible to use water-soluble resins such as polyvinyl alcohol resin, polyethylene oxide resin, polyethylene glycol resin, (meta)acrylic acid resin, (meta)acrylate ester resin, starch and the like, and an organic solvent-soluble resin, such as an acrylic resin (e.g. acrylate ester), styrene-butadiene copolymer resin, urethane resin, polyvinyl acetal resin, polyvinyl butyral resin, polyester resin, epoxy resin, melamine resin, phenol resin, phenoxy resin, cellulose derivative resin and the like, and a resin soluble in a mixed solvent composed of water and an organic solvent, such as polyvinyl acetal resin and acrylate resin. These resins may be used singly or two or more kinds thereof may be used. Moreover, the cured reactants of these resins can be used.

As main components of the adhesive resin for the back surface layer, it is preferable to use an acrylic resin, such as acrylate ester, polyvinyl acetal resin, polyvinyl butyral resin, polyvinyl alcohol resin, starch or phenoxy resin.

It is necessary that the weight ratio of the polyvinyl pyrrolidone resin based on the total solid content of the back surface layer be from 1 to 50% by weight, preferably from 2 to 35% by weight, and more preferably from 3 to 20% by weight. Incidentally, if the weight ratio of the polyvinyl pyrrolidone resin based on the total solid content of the back surface layer is less than 1% by weight, sufficient effect cannot be obtained. On the other hand, if the weight ratio is more than 50% by weight, the waterproof strength of the coating film of the back surface layer tends to decrease.

The polyvinyl pyrrolidone resin of the present invention includes, for example, a homopolymer of a vinyl pyrrolidone, such as N-vinyl-2-pyrrolidone, N-vinyl-4-pyrrolidone, or copolymers of them. Furthermore, the copolymer of vinyl pyrrolidone described above and a copolymerizable monomer can also be used. The copolymerizable monomer other than a vinyl pyrrolidone includes, for example, vinyl monomers such as, styrene, vinyl acetate, (meta)acrylate ester, (meta)acrylonitrile, maleic anhydride, vinyl chloride, vinilidene chloride, α-olefin, dimethylamino methylmethacrylate, vinylcaprolactam and the like.

Moreover, there can be used a block copolymer or graft copolymer or the like of polyvinyl pyrrolidone and, polyester resin, polycarbonate resin, polyurethane resin, epoxy resin, acetal resin, butyral resin, formal resin, phenoxy resin, cellulose resin, and so forth.

Among these polyvinyl pyrrolidone resins, a homopolymer of vinyl pyrrolidone has good hydrophilicity with an aqueous ink, good coating stability, low cost, and therefore, the homopolymer is preferably used. Moreover, the homopolymer of a vinyl pyrrolidone is preferable because its glass transition temperature is high and the anti-offset property is good. In addition, having the anti-offset property means that when the back surface layer and the printed receiving sheet are superposed, the printed dye of the receiving layer can be prevented from transferring to the back surface layer.

It is preferable that the average molecular weight of the polyvinyl pyrrolidone resin is in a range of 50,000 to 2,000,000, and more preferably 60,000 to 1,800,000. Incidentally, if the weight average molecular weight (Mw) of the polyvinyl pyrrolidone resin is less than 50,000, the adhesiveness between the sheet-like support and the back surface layer may deteriorate, and if the weight average molecular weight is more than 2,000,000, the viscosity of the coating material may rise, resulting in coating property of the back surface layer becoming poor.

If the polyvinyl pyrrolidone resin is used excessively for the back surface layer, although the printability in an ink jet printer and the absorption of an aqueous ink in writing by an aqueous pen would be good, the coating film strength of the back surface layer absorbing an aqueous ink would deteriorate and the back surface layer coating film may deteriorate when contacted with the end of a writing instrument. Therefore, in order to improve ink jet printer printability or coating film strength without writability, it is preferable that as a resin for improving waterproof strength of the coating film, a polyalkylene oxide resin be used together.

As the polyalkylene oxide resin, for example, a polyethylene oxide resin, polypropylene oxide resin, neoxide resin, and so forth are preferably used. Among them, the polyethylene oxide resin has hydrophilicity, but a low moisture-absorbing property and good affinity with another resin, thereby the waterproof strength of the coating film can be improved, and therefore, the polyethylene oxide resin is more preferably used.

The polyethylene oxide resin used preferably for the back surface layer of the present invention is a resin produced by ring-opening and polymerizing ethylene oxide monomers, and it is preferable that its average molecular weight is in a range of 80,000 to 800,000, more preferably, 100,000 to 500,000. If the average molecular weight is less than 80,000, the effect of improving water-resistance to the coating film is poor, and if the average molecular weight is more than 800,000, there is a possibility that viscosity of the coating material rises, resulting in the coating property of the coating material becoming poor.

It is preferable that a weight ratio of the polyalkylene oxide resin with respect to the total of the solid content weight of the back surface layer is 3 to 20% by weight, more preferably, 4 to 18% by weight. Incidentally, if the weight ratio of the polyalkylene oxide resin with respect to the total of the solid content weight of the back surface layer is less than 3% by weight, the waterproof strength of the coating film of the back surface layer becomes insufficient, and if the weight ratio is more than 20% by weight, the printability of the ink jet printer is in danger of becoming poor.

Acrylate ester-based resins used preferably as the adhesive resin for the back surface layer of the present invention include homopolymers of (meta)acrylate ester or of its derivative, or resins obtained by copolymerizing them and another copolymerizable monomer (such as acrylic acid, methacrylic acid, vinyl acetate, and styrene). Resins can be obtained in the form of an aqueous solution or aqueous dispersion liquid. For this resin coat, a resin coat having water resistance after being dried can be formed and is effective for improving the waterproof strength of the back surface layer coating film.

It is preferable that a weight ratio of the acrylate ester resin with respect to the total of the back surface layer solid content be 3 to 40% by weight, more preferably, 5 to 35% by weight. Incidentally, if the weight ratio of the acrylate ester resin with respect to the total of the back surface layer solid content is less than 3% by weight, the waterproof of the coating film of the back surface layer becomes insufficient, and if the weight ratio is more than 40% by weight, the printability of the ink jet printer may become poor.

It is preferable that the solid content coating amount in the back surface layer be in a range of 0.5 to 10 $g/m^2$, and more preferably, 1 to 7 $g/m^2$. Incidentally, if the solid content coating amount is less than 0.5 $g/m^2$, the back surface layer cannot completely cover the sheet-like support surface, and film defects may arise. On the other hand, if the solid content coating amount is more than 10 $g/m^2$, the effect is saturated and the cost becomes higher and is economically disadvantageous.

Furthermore, for the coating solution for forming the back surface layer, optionally various additives such as, an antistatic agent, lubricant, microparticles (also referred to as filler), mold release agent, antifoamer, dispersant, cross-linker for resin, chromatic dye, fluorescent dye, fluorescent pigment, ultraviolet absorber, and so forth may be appropriately selected and used.

In the back surface layer of the present invention, an antistatic agent may be incorporated for preventing paper-feeding or paper-ejecting trouble due to electrostatic charge as well as traveling performance. The antistatic agents include anionic, cationic, nonioic and amphoteric surfactants. Conductive agents of a high-molecular resin type include a conductive resin of anionic, cationic, and nonic, inorganic micro powders with electron conductivity, carbon micro powders, and so forth, but the conductive agent of a high-molecular resin type is used preferably because of its long-term antistatic effect and in terms of the hue of the antistatic agent, etc.

As the conductive agent of the high-molecular resin type, a cation-type conductive resin is known to be good, but is expensive and causes amine odor in pyrolysis, and therefore, an anionic conductive resin is preferably used. The anionic conductive resin includes a high molecular containing carboxylic group, sulfonic group, or the like, such as polyacrylic acid, polymethacrylic acid, vinylchloride-maleic acid mono (2-ethylhexyl) copolymer, polystyrene sulfonic acid, and denatured materials thereof, and includes those in which a part or all of the respective functional groups forming alkaline metal salt(s), alkaline earth metal salt(s), or the like. Among them, polyacrylic acid, polymethacrylic acid, and alkali metal salt or alkali earth metal salt of polystyrene sulfonic acid are preferable, and particularly, sodium salt of polystyrene sulfonic acid is preferable because such a salt is excellent in antistatic function, solubility, compatibility with another adhesive resin used together in the back surface layer.

It is preferable that the blending amount of the antistatic agent be 3 to 25% by weight per the total solid content of the back surface layer, and 5 to 20% by weight is further preferable. Incidentally, if the blending amount is less than 3% by weight, surface electric resistance in the receiving sheet back surface side becomes high and sufficient antistatic effect cannot be obtained, and the paper-feeding or paper-ejecting property of the printer, as well as the traveling performance of the receiving sheet may become poor. Moreover, if the blending amount is more than 25% by weight, the strength of the blank sheet coating film of the back surface layer particularly under high temperature and high moisture may deteriorated.

On the back surface layer of the present invention, a lubricant, such as a higher fatty acid salt may be added as the mold release agent. Usable higher fatty acid salts include saturated or unsaturated fatty acid having 12 to 24, preferably, 16 to 20 carbons, specifically, lauric acid, myristic acid, palmitinic acid, stearic acid, behenic acid, linoleic acid, oleic acid, and so forth. Preferably, salts of such a higher fatty acid includes metal salt, such as calcium salt, magnesium salt, aluminum salt, zinc salt, and barium salt. Stearic acid metal salt is particularly preferable, and for example, zinc stearate, calcium stearate, barium stearate, and so forth are exemplified.

It is preferable that the blending amount of the lubricant such as the higher fatty acid salt is 3 to 50% by weight based on the total solid content of the back surface layer, and 5 to 40% by weight is more preferably. Incidentally, if the blending amount of the lubricant is less than 3% by weight, the back surface layer and the ink ribbon tend to be fused and a so-called back printability may become poor. Moreover, if the blending amount is more than 50% by weight, the sliding property of the back surface layer becomes too great, writability and printability of the ink jet printer may become poor and stamp adhesion may deteriorate.

Writing with a pencil can be achieved by grinding down the core (such as graphite) of a pencil by friction with a surface to be written, which is different from the case of writing by a writing instrument using an ink. Accordingly, it is necessary that the back surface layer have appropriate friction and hardness against graphite and such. When the back surface layer surface is excessively rough and hard, the receiving layer surface may be damaged in superposing a plurality of the receiving sheets. In writing with a ball-point pen, ink flows from the end of the pen pressed against the back surface layer surface and is absorbed into the back surface layer, and thereby writing is achieved. Therefore, for achieving good writing properties by pencil and ball-point pen, it is preferable that the back surface layer has appropriate hardness and irregularity.

Moreover, in the back surface layer of the present invention, as the microparticles, inorganic microparticles and/or organic microparticles may be used. The inorganic microparticles include metal such as aluminum, iron, copper, metal oxide such as silica, titanium oxide, zinc oxide, alumina, inorganic salt such as calcium carbonate, barium sulfate, calcium sulfate, and mineral such as kaolin, fired kaolin, clay, talc, diatom earth. Organic microparticles, such as nylon resin, styrene resin, acrylate resin, urea resin, melamine resin, benzoguanamine resin, phenol resin, silicone resin and fluorine resin can be optionally used together. Among these particles, nylon resin particles are preferably used because of appropriately low hardness.

Nylon resin includes resin particles composed of nylon 12, nylon 6, or nylon 6·6. As types of the nylon resin particles, nylon 12 resin particles are preferable because the particles have excellent water resistance and small characteristic change by water absorption, compared to nylon 6 and nylon 6·6 resin particles. It is preferable that the molecular weight of the nylon resin particle be from 100,000 to 1,000,000. A sphere is preferable as its shape, and although its particle diameter cannot be completely determined according to type of the adhesive resin, it is preferable that the size is an average particle diameter of 3 to 30 μm. If the average particle diameter of the nylon resin particles are less than 3 μm, the nylon resin particles are buried in the back surface layer and the friction coefficient lowering effect and the antistatic effect are insufficient, and therefore, the paper-feeding or paper ejecting property, and traveling performance are occasionally bad. On the other hand, if the average particle diameter of the nylon resin particles is greater than 30 μm, the projection of the nylon resin particles from the back surface layer surface becomes significant, and thus when the back surface layer and the receiving layer are strongly contacted with each other, patterns may be made in the receiving layer, thereby a gap may occur in the printing image. Moreover, when the receiving sheet is frictioned, nylon resin particles occasionally drop out. These nylon resin particles may be used singly or two or more kinds may be used together.

It is preferable that the blending amount of the nylon resin particles be 2 to 25% by weight based on the total solid content of the back surface layer, and 3 to 20% by weight is further preferable. Incidentally, if the blending amount is less than 2% by weight, it is difficult to obtain the friction coefficient-lowering effect between the receiving sheets, and the antistatic effect is insufficient, and therefore, overlap feeding of the receiving sheet (which may cause trouble in printing in which a plurality of receiving sheets are fed at the same time in printing of receiving sheet by a printer) may easily occur. On the other hand, if the blending amount is more than 25% by weight, the lines due to precipitation of the nylon resin particles may easily occur, and deterioration of the coating surface may occur. Moreover, the effect for lowering friction coefficient, antistatic efficient, and so forth are saturated and cost increases.

(Sheet-Like Support)

As the sheet-like support used in the present invention, there can be exemplified a paper substrate such as coated paper, art paper, and high-quality paper, resin coated paper in which a thermoplastic resin is coated on a paper substrate, laminated paper in which a thermoplastic resin such as polypropylene or polypropylene is extruded and laminated on a paper substrate, thermoplastic resin film such as polyethylene terephthalate, nylon, polyolefin (such as polypropylene, polyethylene, mixture of polyethylene and polypropylene), film having a structure of a porous monolayer or multilayer in which voids are formed by uniaxially and/or biaxially oriented a melted resin composition in which a thermoplastic resin such as polyolefin resin or polyethylene terephthalate resin and a void-forming agent (inorganic pigment or organic microparticles) serve as main components. Furthermore, not only the above-described material can be used alone, but also a paper having a multilayer structure by bonding two kinds or more of the materials by a known method, such as a dry laminating method, a wet laminating method, or a melting laminating method, and the combination is not limited.

Moreover, on at least one surface of the paper substrate, a coating paper provided with a coating layer containing hollow particles and binders as the main components can also be used.

Also, a sheet-like support composed of an adhesive sheet having a structure of a so-called seal type (also called as sticker or label type) can be used.

It is preferable that a thickness of the sheet-like support be 100 to 300 μm. Incidentally, if the thickness is less than 100 μm, its mechanical strength becomes insufficient and the stiffness of the receiving sheet obtained therefrom and repulsion against deformation becomes insufficient, and curling of the receiving sheet caused during printing cannot be prevented sufficiently. Moreover, if the thickness is more than 300 μm, the thickness of the receiving sheet becomes too great, and this may lead to a problem such as a decrease of the number of the receiving sheets contained in a printer or an increase of the size of the printer. As a result, compactification of the printer may be difficult.

(Intermediate Layer)

In the receiving sheet of the present invention, for improvement of adhesiveness between the sheet-like support and the receiving layer, improvement of the antistatic property of the receiving sheet, improvement of barrier property, and so forth, an intermediate layer may be provided. As a resin used for formation of the intermediate layer, various hydrophilic resins or hydrophobic resins can be used, and there can be used, for example, a vinyl polymer such as polyvinyl alcohol and polyvinyl pyrrolidone and its derivative, a polymer containing an acrylic group such as polyacrylic polyacrylamide, polydimethylacrylamide, polyacrylic acid or its salt, and polyacrylate ester, a polymer containing a methacrylic group such as polymethacrylic acid and polymethacrylic ester, and a resin such as polyester-based resin, polyurethane-based resin, starch, denatured starch, and cellulose derivative such as carboxymethyl cellulose. Moreover, known antistatic agents and cross-linking agents can be used singly or used together with the above-described resin(s).

It is preferable that the solid content coating amount of the intermediate layer is in a range of 0.2 to 5 $g/m^2$, further preferably, in a range of 0.5 to 3 $g/m^2$. By the way, if the solid coating amount is less than 0.2 $g/m^2$, the adhesive improving effect is less than the intermediate layer. On the other hand, if more than 5 $g/m^2$, blocking or operating property may deteriorate.

(Receiving Layer)

In the receiving sheet of the present invention, the receiving layer provided on one surface of the sheet-like support is formed so that a resin with a dyeing property capable of fixing the dye transferred from the ink ribbon serves as a main component. Such a resin with a dye dyeing property includes polyester resin, vinyl chloride-vinyl acetate copolymer resin, polyvinyl acetal resin, acrylate resin, polycarbonate resin, and cellulose derivative resin.

The solid content coating amount of the receiving layer is controlled in a range of 1 to 12 g/m$^2$, preferably, 2 to 10 g/m$^2$. Incidentally, if the solid content coating amount is less than 1 g/m$^2$, the receiving layer cannot completely cover the support surface, and occasionally, lowering of image quality or the fusing of the receiving layer and the ink ribbon may be caused by heating a thermal head. On the other hand, if the solid content coating amount is 12 g/m$^2$, not only the effect is saturated and not economical, but also, the strength of the receiving layer may become insufficient or the insulation effect of the sheet-like support may not be sufficiently exerted and therefore image concentration may become poor.

It is preferable that in the receiving layer, a crosslinking agent, lubricant, and remover for the resin with a dyeing property are added to prevent fusion between the receiving layer and the ink ribbon in thermal heating in a thermal head. Moreover, optionally, another additive such as a chromatic pigment, chromatic dye, fluorescent pigment, fluorescent dye, plasticizer, antioxidant, white pigment, ultraviolet absorber, light stabilizer, and so forth may be added. Such additives may be mixed with the main component of the receiving layer and coated, and may be coated as another coating layer above and/or below the receiving layer.

The coating layers of the receiving sheet of the present invention such as, the intermediate layer, receiving layer, and back surface layer can be formed by being coated and dried by a known coater such as bar coater, gravure coater, comma coater, blade coater, air-knife coater, gate roll coater, dye coater, curtain coater, and slide bead coater, and so forth.

EXAMPLES

The present invention will now be described in detail with reference to the following Examples and Comparative Examples, but the scope of the present invention is not limited thereto. In the Examples and Comparative Examples, parts and percentages are by weight unless otherwise specified.

The molecular weight of the polyvinyl pyrrolidone used herein was analyzed by using a column for analyzing gel permeation chromatography (GPC) (trade name: Showdex SB-805 HQ, manufactured by Showa Denko Co., Ltd.) and using a mixture of an aqueous $NaNO_3$ solution and acetonitrile in a weight ratio of 90:10 as the solvent. As a standard sample, commercially available polyvinyl pyrrolidone (manufactured by Wako Pure Chemical Industries, Ltd) having a known molecular weight was used.

The molecular weight of the polyethylene oxide used herein was analyzed by using a column for analyzing gel permeation chromatography (GPC) (trade name: Showdex asahipak CF-710 HQ, manufactured by Showa Denko Co., Ltd.) and using LiCl (having a concentration of 50 mM) as the solvent. As a standard sample, TSK polyethylene oxide (manufactured by Tosoh Co., Ltd.) having a known molecular weight was used.

Example 1

On the front and back surfaces of a polyethylene terephthalate (PET) film having a thickness of 50 μm, a biaxially oriented porous multilayered film (trade name: YUPO FPG60, manufactured by YUPO Corporation) having a thickness of 60 μm, which contains an inorganic pigment and contains polyolefin as a main component, was laminated using a polyester-based adhesive to obtain a sheet-like support.

On one surface of the support, the following coating solution for receiving layer-1 was coated using a gravure coater and then dried to form a receiving layer having a coating amount (solid content) of 5 g/m$^2$. Then, the receiving layer was crosslinked by maintaining in an atmosphere of 50° C. for 3 days.

| Coating solution for receiving layer-1 | |
|---|---|
| Polyester resin (trade name: Byron 200, manufactured by Toyobo Co., Ltd.) | 100 parts |
| Silicone oil (trade name: KF393, manufactured by Shin-Etsu Chemical Co., Ltd.) | 3 parts |
| Isocyanate compound (trade name: Takenate D110N, manufactured by Mitsui Takeda Chemical Co., Ltd.) | 5 parts |
| Mixed solution of toluene and methyl ethyl ketone in a weight ratio of 1:1 | 400 parts |

On the surface opposite to the surface on which the receiving layer was formed, of the sheet-like support, the following coating solution for back surface layer-2 was coated using a gravure coater and then dried to obtain a back surface later having a coating amount (solid content) of 3 g/m$^2$.

| Coating solution for back surface layer-2 | |
|---|---|
| Polyvinyl pyrrolidone resin (trade name: Polyvinyl pyrrolidone K90, weight average molecular weight: 1,600,000, manufactured by ISP Japan Co., Ltd.) | 45 parts |
| Acrylate ester resin (trade name: Julimar AT613, manufactured by Nihonjunyaku Co., Ltd.) | 15 parts |
| Nylon resin particle (trade name: MW330, nylon 12 resin, average particle diameter: 7 μm, manufactured by Shinto Paint Co., Ltd.) | 10 parts |
| Zinc stearate (trade name: KW509, manufactured by Goo Chemical Co., Ltd.) | 20 parts |
| Anionic conductive resin (trade name: CHEMISTAT SA-9, main component: sodium polystyrene sulfonate, manufactured by Sanyo Chemical Industries Co., Ltd.) | 10 parts |
| Mixed solution of water and isopropyl alcohol in a weight ratio of 2/3 | 500 parts |

Example 2

In the same manner as in Example 1, except that the amount of the polyvinyl pyrrolidone resin was replaced by 30 parts and the amount of an acrylate ester resin was replaced by 30 parts in the coating solution for back surface layer-2 of Example 1, a receiving sheet was obtained.

Example 3

In the same manner as in Example 1, except that the following coating solution for back surface layer-3 was used instead of the coating solution for back surface layer-2, a receiving sheet was obtained.

| Coating solution for back surface layer-3 | |
|---|---|
| Polyvinyl pyrrolidone resin (trade name: Polyvinylpyrrolidone K90, weight average molecular weight: 1,600,000, manufactured by ISP Japan Co., Ltd.) | 18 parts |
| Acrylate ester resin (trade name: Julimar AT613, manufactured by Nihonjunyaku Co., Ltd.) | 27 parts |
| Nylon resin particle (trade name: MW330, nylon 12 resin, average particle diameter: 7 μm, manufactured by Shinto Paint Co., Ltd.) | 15 parts |
| Zinc stearate (trade name: KW509, manufactured by Goo Chemical Co., Ltd.) | 25 parts |
| Anionic conductive resin (trade name: CHEMISTAT SA-9, main component: sodium polystyrene sulfonate, manufactured by Sanyo Chemical Industries Co., Ltd.) | 15 parts |
| Mixed solution of water and isopropyl alcohol in a weight ratio of 2/3 | 500 parts |

Example 4

In the same manner as in Example 1, except that the amount of the polyvinyl pyrrolidone resin K90 was replaced by 5 parts in the coating solution for back surface layer-3 of Example 3, a receiving sheet was obtained.

Example 5

In the same manner as in Example 3, except that a polyvinyl pyrrolidone resin (trade name: polyvinyl pyrrolidone resin K30, weight average molecular weight was 70,000, manufactured by ISP Japan Co., Ltd.) was used instead of a polyvinyl pyrrolidone resin K90 in the coating solution for back surface layer-3 of Example 3, a receiving sheet was obtained.

Example 6

In the same manner as in Example 1, except that the following coating solution for back surface layer-4 was used instead of the coating solution for back surface layer-2 in Example 1, a receiving sheet was obtained.

| Coating solution for back surface layer-4 | |
|---|---|
| Polyvinyl pyrrolidone resin (trade name: Polyvinyl pyrrolidone K90, weight average molecular weight: 1,600,000, manufactured by ISP Japan Co., Ltd.) | 11 parts |
| Polyethylene oxide resin (trade name: ALKOXOR150, weight average molecular weight: 140,000, manufactured by Meisei Chemical Works, Ltd.) | 11 parts |
| Acrylate ester resin (trade name: Julimar AT613, manufactured by Nihonjunyaku Co., Ltd.) | 27 parts |
| Nylon resin particle (trade name: MW330, nylon 12 resin, average particle diameter: 7 μm, manufactured by Shinto Paint Co., Ltd.) | 15 parts |
| Zinc stearate (trade name: KW509, manufactured by Goo Chemical Co., Ltd.) | 25 parts |
| Anionic conductive resin (trade name: CHEMISTAT SA-9, main component: Sodium polystyrene sulfonate, manufactured by Sanyo Chemical Industries Co., Ltd.) | 15 parts |
| Mixed solution of water and isopropyl alcohol in a weight ratio of 2/3 | 500 parts |

Example 7

In the same manner as in Example 6, except that the amount of a polyvinyl pyrrolidone resin was replaced by 6 parts and the amount of a polyethylene oxide resin was replaced by 6 parts in the coating solution for back surface layer-4 of Example 6, a receiving sheet was obtained.

Comparative Example 1

In the same manner as in Example 1, except that the back surface layer was not formed in Example 1, a receiving sheet was obtained.

Comparative Example 2

In the same manner as in Example 1, except that a polyvinyl alcohol resin (trade name: PVA105, manufactured by Kuraray Co., Ltd.) was used in place of the polyvinyl pyrrolidone resin, a receiving sheet was obtained.

Comparative Example 3

In the same manner as in Example 1, except that the amount of the polyvinyl pyrrolidone resin was replaced by 55 parts and the amount of the acrylate ester resin was replaced by 5 parts in the coating solution for back surface layer-2 of Example 1, a receiving sheet was obtained.

Quality Evaluation

The receiving sheets obtained in Examples 1 to 7 and Comparative Examples 1 to 3 were subjected to the following quality evaluation tests. The evaluation results are shown in Table 1.

[Ink Jet Printer Compatibility]

The receiving sheet was set in an ink jet printer (trademark: BJC610JW, manufactured by Canon Co., Ltd.), and the letter image was printed on the surface of a back surface layer of the ink jet sheet at a mode of 720 dpi×720 dpi, and printability using the ink jet printer was evaluated by the following criteria.

Excellent: Blur of the letter does not occur at all and the letter is easy to read; excellent printability Good: slight blur occurs but is readable with no problems; good printability Fair: slight blur of the letter occurs, but it is possible to put into practical use Failure: severe blur of the letter occurs and cannot be read; it is impossible to put into practical use

[Printing Water Resistance of Ink Jet Printer]

The receiving sheet was set in an ink jet printer (trademark: BJC610JW, manufactured by Canon Co., Ltd.), and the letter image was printed on the surface of a back surface layer surface of the ink jet sheet at a mode of 720 dpi×720 dpi mode. After dropping one water droplet on the printed area and slightly rubbing with tissue paper, water resistance of the printed image was evaluated by the following criteria.

Excellent: Image is not removed when the printed surface is rubbed; excellent water resistance Good: Image is slightly removed when the printed surface is rubbed; good water resistance Fair: Image is slightly removed when the printed surface is rubbed; it is possible to put in practical use Failure: Image is severely removed when the printed surface is rubbed; it is impossible to put in practical use

[Stamp Adhesion Property]

The entire surface of an adhesive surface of Japanese 50-yen postal stamp was coated with tap water using fingers and the stamp was applied onto the back surface layer surface of the receiving sheet. The stamp was allowed to stand for 24 hours, and then the stamp adhesion was evaluated by the following criteria.

Good: Stamp adheres after 24 hours

Failure: Stamp does not adhere after 24 hours and can be peeled off by hand after 24 hours; it is impossible to put into practical use.

[Writability]

As writing utensils used generally, a pencil (hardness HP), a ball pen, an aqueous pen and an oily pen were prepared, and a letter was written on the surface of a back surface layer surface of a receiving sheet, and then writability was generally evaluated by the following criteria.

Excellent: Any blur of the letter does not occur at all; good writability

Good: Slight blur of the letter occurs in case of some writing utensils; good writability Fair: Slight blur of the letter occurs in case of some writing utensils; it is possible to put into practical use Failure: Severe blur of the letter occurs; it is impossible to read, write and put into practical use

TABLE 1

| | Ink jet printer compatibility | | Stamp | |
|---|---|---|---|---|
| | Printability | Printing water resistance | adhesion property | Writability |
| Example 1 | Fair | Fair | Good | Fair |
| Example 2 | Good | Good | Good | Fair |
| Example 3 | Excellent | Good | Good | Good |
| Example 4 | Good | Excellent | Good | Good |
| Example 5 | Good | Good | Good | Good |
| Example 6 | Excellent | Excellent | Good | Excellent |
| Example 7 | Excellent | Excellent | Good | Excellent |
| Comparative Example 1 | Failure | Failure | Failure | Failure |
| Comparative Example 2 | Failure | Failure | Good | Fair |
| Comparative Example 3 | Failure | Failure | Good | Fair |

INDUSTRIAL APPLICABILITY

In the receiving sheet of the present invention, the back surface layer has good printability by an ink jet printer and also has sufficient writability for various writing instruments, and therefore the receiving sheet can be utilized as a receiving sheet which is inexpensive and has high practical value.

The invention claimed is:

1. A thermal transfer receiving sheet comprising a support, an image receiving layer containing, as a main component, a dye-dyeable resin formed on one surface of the support, and a back surface coating layer containing an adhesive resin formed on the other surface of the sheet-like support, wherein the back surface coating layer further contains a polyvinyl pyrrolidone resin and a polyalkylene oxide resin, wherein the polyvinyl pyrrolidone resin is in an amount of 1 to 50% by weight based on the total solid content of the back surface coating layer and wherein the weight ratio of the polyalkylene oxide resin with respect to the total of the solid content weight of the back surface layer is 3 to 20% by weight.

2. The thermal transfer receiving sheet according to claim 1, wherein a weight average molecular weight of the polyvinyl pyrrolidone resin is from 50,000 to 2,000,000.

3. The thermal transfer receiving sheet according to claim 1 or 2, wherein the back surface coating layer contains an acrylate ester-based resin as the adhesive resin.

4. The thermal transfer receiving sheet according to claim 1 or 2, wherein the back surface coating layer contains inorganic fine particles and/or organic fine particles.

5. The thermal transfer receiving sheet according to claim 1, wherein the polyalkylene oxide resin is a polyethylene oxide resin.

* * * * *